US006769668B2

(12) United States Patent
Siglock

(10) Patent No.: US 6,769,668 B2
(45) Date of Patent: Aug. 3, 2004

(54) LIFTING DEVICE ASSEMBLY

(75) Inventor: John V. Siglock, Sierra Madre, CA (US)

(73) Assignee: Larin Corporation, Ontario, CA (US)

( * ) Notice: Subject to any disclaimer, the term of this patent is extended or adjusted under 35 U.S.C. 154(b) by 0 days.

(21) Appl. No.: 10/045,985

(22) Filed: Oct. 26, 2001

(65) Prior Publication Data

US 2002/0153516 A1 Oct. 24, 2002

Related U.S. Application Data

(60) Provisional application No. 60/243,923, filed on Oct. 27, 2000.

(51) Int. Cl.[7] ..... B66F 5/04

(52) U.S. Cl. ..... 254/124; 254/8 B; 254/133 R

(58) Field of Search ..... 254/2 R, 2 B, 254/2 C, 8 R, 8 B, 8 C, 10 R, 10 B, 10 C, 124, 9 R, 9 B, 9 C, 93 H, 133 R, 134; 269/17

(56) References Cited

U.S. PATENT DOCUMENTS

| | | | | | |
|---|---|---|---|---|---|
| 3,599,812 A | * | 8/1971 | Hasstedt et al. | ..... | 254/8 B |
| 4,077,607 A | | 3/1978 | Lovelady | | |
| 4,289,299 A | * | 9/1981 | Kameda | ..... | 254/8 B |
| 4,457,492 A | | 7/1984 | Lahti | | |
| 4,848,732 A | * | 7/1989 | Rossato | ..... | 254/134 |
| 5,538,308 A | | 7/1996 | Floe | | |
| 5,588,639 A | | 12/1996 | Holman | | |
| 5,601,277 A | | 2/1997 | Larson | | |
| 5,769,396 A | | 6/1998 | Tischendorf | | |
| 6,050,546 A | | 4/2000 | Peschmann et al. | | |
| 6,168,138 B1 | | 1/2001 | Dhein | | |
| 6,241,227 B1 | * | 6/2001 | Berdan et al. | ..... | 269/17 |
| 6,416,039 B1 | * | 7/2002 | Pietrusynski | ..... | 254/8 B |

* cited by examiner

*Primary Examiner*—Robert C. Watson
(74) *Attorney, Agent, or Firm*—Kenneth L. Sherman; Vic Lin; Myers Dawes Andras & Sherman LLP

(57) ABSTRACT

A jack for lifting an object includes a base assembly and a jacking assembly. The base assembly has a frame with a base member having a nesting chamber, lifting arms pivotably connected to the base member, and a support member for supporting the object. The support member is pivotably connected to the lifting arms and is disposed parallel to the base member. The support member and the lifting arms pivot with respect to the base member into positions including a fully raised position wherein the support member is lifted away from the base member and a fully lowered position wherein the support members and the lifting arms are at least partly nested within the nesting chamber. The jacking assembly is connected to the base assembly for moving the support members and the lifting arms from the fully lowered position towards the fully raised position.

30 Claims, 5 Drawing Sheets

LIFTING DEVICE ASSEMBLY

CROSS-REFERENCE TO RELATED APPLICATION

This application claims the benefit of U.S. Provisional Application No. 60/243,923 , filed Oct. 27, 2000.

BACKGROUND OF THE INVENTION

1. Field of the Invention

The invention lies in the field of lifting equipment. The invention relates to a lifting device used to lift motorcycles or other suitable loads, especially suitable for loads having a low ground clearance. The lifting device of the present invention provides additional stability and improved safety. Also provided is an adjustable stabilizing element that can be used with the lifting device of the present invention or with conventional jacks, particularly jacks for motorcycles and/or all-terrain vehicles.

2. Description of the Related Art

Generally, different types of jacks exist in the prior art for lifting motorcycles or similar loads, such as hydraulic jacks, articulated jacks, and screw operated jacks.

U.S. Pat. No. 6,168,138 to Dhein describes a universal lift system for use in combination with a conventional hydraulic floor jack. The universal lift system replaces the mounting bracket on the floor jack with a substantially H-shaped attachment device having a kingpin that fits into a hole on the conventional jack. The lift system also includes a separate stabilizing device that attaches to the bottom of the floor jack. The lift system has a third separate part called an adjustable support device. The lift system is particularly suitable for lifting and supporting two-wheeled motorized vehicles. The universal lift system, however, is not configured to lift and support objects having a small floor-to-object clearance.

U.S. Pat. No. 4,457,492 to Lahti discloses a lifting apparatus for lifting a load, such as a motorcycle. The Lahti apparatus uses a lever operable cam to raise or lower the load. The Lahti apparatus, however, is not suitable for lifting and supporting objects having a small floor-to-object clearance. In fact, the clearance must be greater than the overall height of the Lahti apparatus, to wit, from the casters to the top of the load support.

U.S. Pat. No. 5,588,639 to Holman teaches a single-person operable support structure for lifting a motorcycle in combination with a common hydraulic floor jack. The support structure can support a motorcycle on the common jack in a variety of angular orientations. The Holman structure is limited to objects having a floor-to-bottom clearance that is greater than the sum of the height of the Holman retrofit structure plus the height of the common floor jack.

U.S. Pat. No. 5,601,277 to Larson is drawn to a two-piece jacking system for two-wheeled vehicles including a jacking mechanism and an adjustable separate support stand. Both the jacking mechanism and the stand have adjustable threaded bolts for adjusting the devices when they are placed on uneven surfaces. Again, the Larson structure is limited to objects having a floor-to-bottom clearance that is greater than the height of the Larson jacking mechanism.

U.S. Pat. No. 5,769,396 to Tischendorf discloses a multi-purpose motorcycle lift somewhat similar to the Lahti apparatus. A foot-operated stirrup is directly connected to one, of a pair of lifting beams connected to support bars. When the stirrup is pressed downwards, the lifting beams are forced to pivot and raise the support bars, with the motorcycle, until the lifting beams are moved past the vertical. Again, the Tischendorf structure is limited to raising objects having a floor-to-bottom clearance that is greater than the height of the entire Tischendorf structure before it is rotated to raise the lifting beams. The lifting beams are individually adjustable to correspond to lifting points on the motorcycle that are uneven with respect to ground.

U.S. Pat. No. 4,077,607 to Lovelady describes a complex service rack for motorcycles, the rack having a platform to support the motorcycle wheels including a ramp and a clamp for holding one of the motorcycle wheels therein. The servicing rack is almost as large as the motorcycle and is not configured to fit under objects having a small floor-to-object bottom clearance.

Some common problems exist among these prior art jacks. One problem is that the minimum required clearance height between the ground and the load is five inches or more. Newly-manufactured motorcycles, however, may only have two or three inches of ground clearance. Therefore, to utilize commonly available lifting devices, the user is required to drive or push the motorcycle onto supporting planks or blocks to artificially create the necessary minimum clearance for the prior art lifting device. Such an operation can be difficult and dangerous. It is, therefore, desirable to provide a low-profile lifting device that can accommodate the required low clearance without any extra lifting operation.

Additionally, the considerable extension of a load over a jack very often causes the problem of load instability. It is, therefore, desirable to provide additional stability when lifting the load. Additional stability is especially necessary for a small profile jack that is used on motorcycles having a low ground clearance.

Conventional jacks typically have flat lifting surfaces. Some motorcycles, however, do not have uniformly flat lower surfaces. Alternatively, the lifting surfaces may not exist below the center of gravity of the motorcycle. It is, therefore, necessary to provide a supporting device that is adjustable according to different lower surfaces of the motorcycle.

In general, hydraulic jacks may be subjected to unexpected loss of hydraulic pressure. Such loss of pressure may be dangerous, and could cause damage or injury. Some of the existing jacks on the market have employed safety devices to reduce pressure loss hazards. Such safety devices are generally of the nature of pawls that engage fixed "teeth" on the jack frame. However, such devices suffer from the drawback that the user must remember to engage the safety device.

Another drawback of these devices lies in the release of the safety devices. Due to the symmetrical nature of these jacks, it is common practice to employ a safety pawl on either side of the device. When releasing such a safety device, therefore, the user must retract one pawl on each side of the jack while simultaneously rotating the release valve to lower the jack. The great difficulty in performing three operations simultaneously, without assistance from another person, leads to non-use of the safety device. It is, therefore, very important to provide a safety device that can be released easily by a single operator.

It is accordingly an object of the present invention to provide a low profile lifting device that is useful for raising motorcycles or other suitable loads with a low ground clearance and without any extra operation.

Another object of the present invention is to provide a lifting device with improved safety measures, particularly, a safety device that engages automatically and can be released by a single person in a single operation.

It is still another object of the present invention to provide an adjustable receiving element that may be used to lift loads that may not be conveniently lifted by a lifting device with a typical flat lifting surface. The adjustable receiving element can be used either as an attachment to an existing lifting device or incorporated into a lifting device.

It is yet still another object of the present invention to provide a lifting device with a stabilizing element for providing additional stability to the lifting device and where the stabilizing element may be adjusted according to the needs of the user.

SUMMARY OF THE INVENTION

With the foregoing and other objects in view there is provided, in accordance with the invention, a motorcycle jack, which has a lower profile to be placed underneath motorcycles and other work pieces having a low ground to work piece profile. The preferred embodiment for implementing these principles comprises a frame having a support member for supporting a motorcycle to be lifted and a base member in connection with a support surface, the frame being convertible between a fully lowered position and a fully raised position, and wherein a height of the support member over the support surface in the fully lowered position is less than 3–4 inches and is 2.5 inches in the preferred embodiment of the present invention.

In a further principle of the present invention, a motorcycle jack includes a means for providing a wider profile than the base once the jack is in place to support the motorcycle. In the preferred embodiment for implementing this inventive principle, the motorcycle jack, comprises a frame having a support member for supporting a motorcycle to be lifted and a base member in connection with a support surface, the frame being convertible between a lowered position and a raised position, the base member having a length dimension and a width dimension, and at least one extending foot connected to the base member, the connecting foot being extendible away from the base member to expand the width dimension of the base member.

In a further principle of the present invention, a motorcycle jack includes a means for engaging a safety mechanism limiting the lowering of the jack and a means for easily disengaging the safety mechanism in conjunction with the interaction of a means for lowering the jack away from the raised position. In the preferred embodiment for implementing this inventive principle, the motorcycle jack comprises a frame having a support member for supporting a motorcycle to be lifted and a base member in connection with a support surface, the frame being convertible between a lowered position and a raised position, safety pawls connected to the frame to engage the frame as the frame is raised and to prevent the lowering of the frame without being released by a releasing member, the releasing member releasing the safety pawls and causing the frame to be lowered.

In the preferred embodiment of the present invention, a jack is provided for lifting an object and the jack contains a base assembly. The base assembly includes a frame having a base member with a nesting chamber, lifting arms pivotably connected to the base member, and a support member for supporting the object to be lifted. The support member is pivotably connected to the lifting arms and is disposed parallel to the base member. The support member and the lifting arms pivoting with respect to the base members into different positions. The different positions include a fully raised position wherein the support member is lifted away from the base member, and a fully lowered position wherein the support members and the lifting arms are at least partly nested within the nesting chamber. The jack further contains a jacking assembly connected to the base assembly for moving the support members and the lifting arms from the fully lowered position towards the fully raised position.

In accordance with an added feature of the preferred embodiment of the present invention, the base member is two base members disposed parallel to one another in a base plane, and each of the two base members has a nesting chamber.

In accordance with another feature of the preferred embodiment of the present invention, each of the two base members has a U-shaped cross-section defining the nesting chamber In accordance with an additional feature of the preferred embodiment of the present invention, the support member has a second nesting chamber, and at least one of the lifting arms is at least partly nested within the second nesting chamber when in the fully lowered position.

In accordance with a further feature of the preferred embodiment of the present invention, the base member is two base members disposed parallel to one another in a base plane. Each of the two base members has a nesting chamber. The support member is two support members disposed parallel to one another in a support member plane and the support member plane is disposed parallel to the base plane. Each of the two support members has a second nesting chamber, the two support members and the lifting arms are at least partly nested within the nesting chamber when in the fully lowered position. At least one of the lifting arms is at least partly nested within the second nesting chamber of each of the two support members when in the fully lowered position.

In accordance with another added feature of the preferred embodiment of the present invention, each of the two base members has a series of ratchet openings disposed in the nesting chamber.

In accordance with another additional feature of the preferred embodiment of the present invention, the frame includes cross-beams fixedly connecting the two base members to one another.

In accordance with another further feature of the preferred embodiment of the present invention, the cross-beams include a first cross-beam and a second cross-beam, and the frame includes a jack platform fixedly connected to the first and second cross-beams.

In accordance with a further added feature of the preferred embodiment of the present invention, the jack platform has a first leg attached to the first cross-beam, and a second leg connected to the first leg and to the second cross-beam.

In accordance with a further additional feature of the preferred embodiment of the present invention, the lifting arms are four lifting arms. Each of the four lifting arms has a substantially same given arm length.

In accordance with an added feature of the preferred embodiment of the present invention, the base member is two base members disposed parallel to one another in a base plane, and a pair of the four lifting arms is pivotably connected to each of the two base members.

In accordance with an additional feature of the preferred embodiment of the present invention, the support member is two support members and are disposed parallel to one another and parallel to the two base members. Each of the two support members is pivotably connected to the pair of the four lifting arms.

In accordance with another feature of the preferred embodiment of the present invention, the two support members and the four lifting arms pivot with respect to the two base members into different positions. The positions include a fully raised position wherein the two support members are lifted away from the two base members; and a fully lowered position wherein one of the two support members and two of the four lifting arms are each at least partly nested within a nesting chamber of a respective one of the base members.

In accordance with a further feature of the preferred embodiment of the present invention, a ram support is pivotably connected to the lifting arms, and a removable hydraulic jack is removably connected to the ram support and to the base assembly. The jack moves the support member and the lifting arms from the fully lowered position towards the fully raised position through the ram support.

In accordance with the preferred embodiment of the present invention, the lifting arms are four lifting arms, and two of the four lifting arms are disposed closer to the jacking assembly than two other arms of the four lifting arms. Each of the two lifting arms disposed closer to the jacking assembly has a pivot, and the ram support is pivotably connected to a respective one of the two lifting arms disposed closer to the jacking assembly at the pivot.

In accordance with yet another feature of the preferred embodiment of the present invention, the frame includes a jack platform fixedly connected to the base member, and the jack platform has an attachment clamp removably connecting the jack to the jack platform.

In accordance with yet a further feature of the preferred embodiment of the present invention, the base member is two base members disposed parallel to one another in a base plane. The frame includes cross-beams fixedly connecting the two base members to one another. The cross-beams include a first cross-beam and a second cross-beam. The frame includes a jack platform fixedly connected to the first and second cross-beams, and the jack platform has an attachment clamp removably connecting the jack to the jack platform.

In accordance with another feature of the preferred embodiment of the present invention, the jack platform is disposed in a plane at an angle from the base plane.

In accordance with a further feature of the preferred embodiment of the present invention, the base member is disposed in a base plane, and the attachment clamp removably connects the jack to the jack platform in a plane at an angle from the base plane.

In accordance with an added feature of the preferred embodiment of the present invention, the base member is disposed in a base plane, and the attachment clamp removably connects the jack to the jack platform in a plane at an angle from the base plane.

In accordance with an additional feature of the preferred embodiment of the present invention, the frame includes a jack platform fixedly connected to the base member and the jack platform has an attachment clamp. The hydraulic jack has a base housing a hydraulic fluid, and a lifting piston is moveably disposed in the base. The lifting piston has a piston end and a cap disposed at the piston end. The attachment clamp of the jack platform removably connects the base to the jack platform such that the lifting piston has an axis inclined with respect to the base plane. A pumping piston is moveably connected to the base for exerting pressure upon the hydraulic fluid when moved into a downward position and correspondingly raising the lifting piston out of the base along the axis. A return spring is connected to the pumping piston for returning the pumping piston to a raised position. A pedal flange is pivotably connected to the base. A pedal is pivotably connected to the pedal flange, pivotably connected to the pumping piston, and connected to the return spring such that, when the pedal is depressed from an initial position, the pedal depresses the pumping piston, and, when pressure is released from the pedal, the return spring returns the pedal to the initial position. A pressure release valve is connected to the base for releasing pressure upon the hydraulic fluid.

In accordance with another feature of the preferred embodiment of the present invention, the front ram support has an upper span having two ends and a bracket removably connected to the cap of the lifting piston, and two side spans each having an upper end and a lower end. The upper end of each of the two side spans is fixedly connected to a respective one of the two ends of the upper span to form a U-shape. The lifting arms include two lifting arms disposed closer to the jacking assembly than other arms of the lifting arms. Each of the two lifting arms have a pivot, and the lower end of each of the two side spans is pivotably connected to a respective one of the two lifting arms at the pivot.

In accordance with a further feature of the preferred embodiment of the present invention, a locking assembly is connected to the base assembly for locking the base assembly in one of the positions. The locking assembly can be connected to the lifting arms.

In accordance with the preferred embodiment of the present invention, the lifting arms include two lifting arms, and the locking assembly is connected to the two lifting arms.

In accordance with a further added feature of the preferred embodiment of the present invention, each of the two lifting arms has a pivot. The locking assembly has two locking pawls each having a ratchet portion and an actuating portion. Each of the two locking pawls is pivotably connected to a respective one of the two lifting arms at the pivot for holding the two lifting arms in one of the positions.

In accordance with a further additional feature of the preferred embodiment of the present invention, a lowering assembly is connected to the base assembly and to the jacking assembly for lowering the support member and the lifting arms toward the fully lowered position and for lowering the jacking assembly.

In accordance with another further feature of the preferred embodiment of the present invention, the lowering assembly has a lowering pedal pivotably connected to the jacking assembly. In addition, a release bar is pivotably connected to the base assembly.

In accordance with another added feature of the preferred embodiment of the present invention, the lifting arms include two lifting arms each having a pivot. A locking assembly is connected to the base assembly and has two locking pawls each with a ratchet portion and an actuating portion. Each of the two locking pawls is pivotably connected to a respective one of the two lifting arms at the pivot. The ratchet portion has a locking end. The base member has ratchet openings, and the jack has a pressure release valve. A lowering assembly is provided and has a lowering pedal with a pressure release flange, and the lowering pedal is pivotably connected to the jack. A release bar is pivotably connected to each of the two locking pawls at the actuating portion and is connected to the lowering pedal such that, when the lowering pedal is initially depressed, the release bar pivots both of the two locking pawls to disconnect the locking end from a respective one of the ratchet openings. And, when the lowering pedal is further depressed, the pressure release flange contacts and moves the pressure release valve to release pressure in the jack thereby lowering the lifting arms and the support member towards the fully lowered position.

According to a concomitant feature of the preferred embodiment of the present invention, there is provided a stabilizing member pivotably connected to the base member. Preferably, the stabilizing member has an extendable foot having a foot part, a knob, and a threaded part connecting the foot part to the knob.

Other features that are considered as characteristic for the invention are set forth in the appended claims.

Although the invention is illustrated and described herein as embodied in a lifting device assembly, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DETAILED DESCRIPTION OF THE PREFERRED EMBODIMENTS

Before explaining the preferred embodiment of the present invention in detail, it is to be understood that this invention is not limited in its application to the details of construction and configuration of parts illustrated in the accompanying drawings or described in the description. The terminology employed in this description is utilized to explain the invention to persons skilled in the art and is not intended to be limiting as to the embodiments described.

Figure 1:
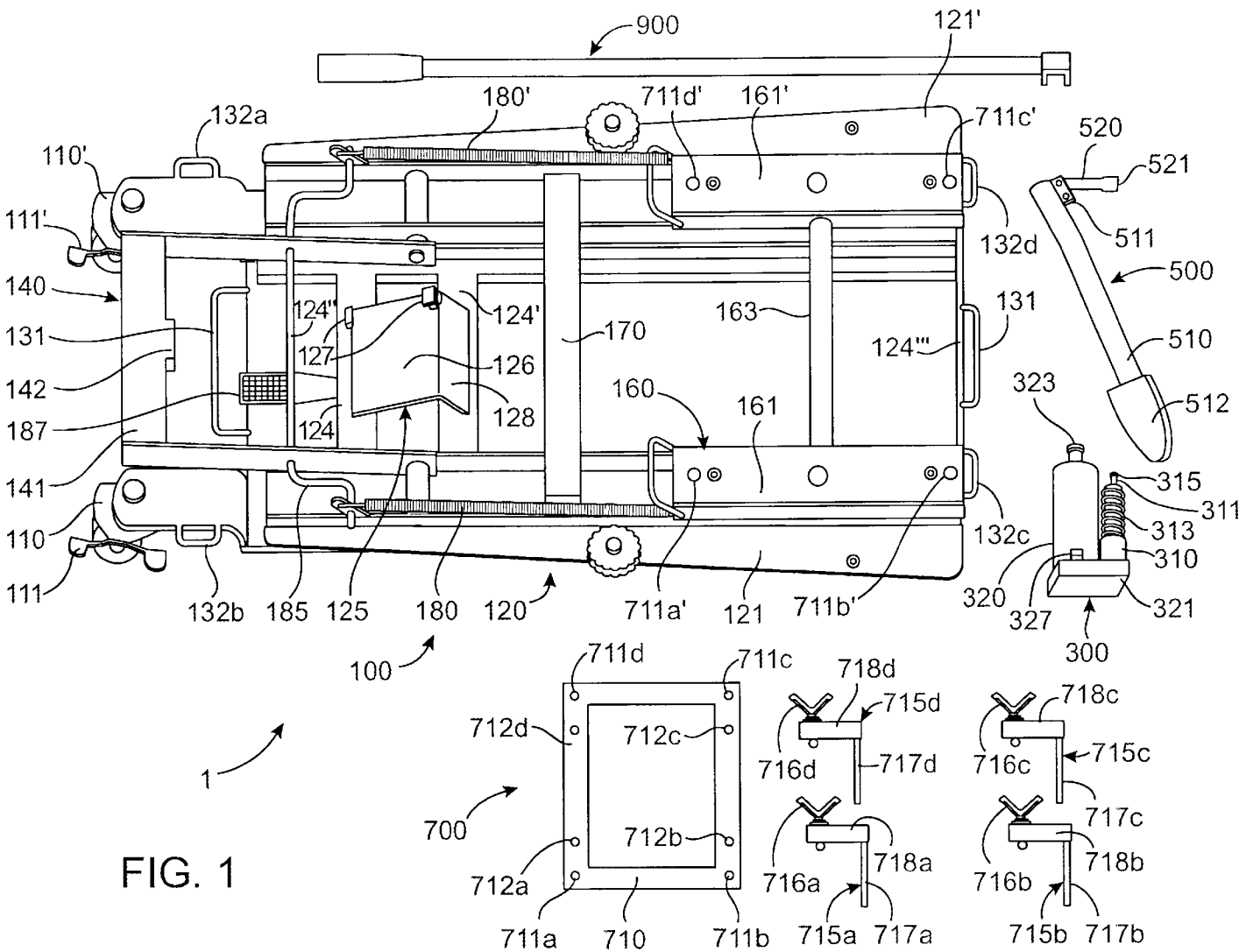
FIG. 1 is a perspective view from above the disassembled lifting device assembly and removable adapter assembly according to the preferred embodiment of the present invention.

Referring now to the figures of the drawings in detail, and first particularly to FIG. 1, there is shown the lifting device assembly according to the preferred embodiment of the present invention in a disassembled state. The lifting device assembly 1 includes a base assembly 100, a hydraulic ram assembly 300, a foot pedal assembly 500, a removable adapter assembly 700, and a pulling handle 900.

The hydraulic ram assembly 300 includes a pump piston 310, a housing 320, and a ram base 321. The pump piston 310 has a piston 311 with a pinhole 315 formed in the top end thereof and a return spring 313 mounted surrounding the piston 311. The housing 320 has a cylinder 322, a plunger 325 (see FIG. 2) movable within the cylinder 322 and a cap 323 mounted on the top end of the plunger 325.

Figure 3:
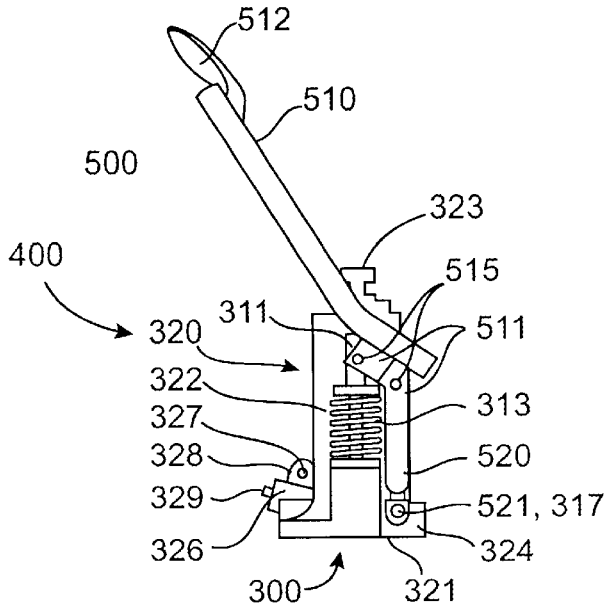
FIG. 3 is a side view of the hydraulic ram assembly and the foot pedal assembly of the lifting device assembly of FIGS. 1 and 2.

As can be better seen from FIG. 3, a pinhole 317 is formed in a protrusion 324 on the ram base 321. Another pinhole 327 is formed in another protrusion 328 located on the top of an air exit cylinder 326 connected to the cylinder 322 at the bottom end thereof. An air leak button 329 fits in the opening of the air exit cylinder 326.

The foot pedal assembly 500 includes a pump lever 510 with two brackets 511 at one end of the pump lever 510, a foot pedal 512 mounted at the other end of the pump lever 510, and a linkage 520. The linkage 520 is pivotably connected to the pump lever 510 at the end close to the two brackets 511 through a pivot pin and a cotter pin. Through-holes 515 are formed in the two brackets 511. Another through-hole 521 is formed at the free end of the linkage 520.

FIG. 3 shows the assembling relationship between the foot pedal assembly 500 and the hydraulic ram assembly 300. The foot pedal assembly 500, including the pump lever 510 pivotally coupled to the linkage 520, is first connected to the ram base 312 by a first pin passed through pinholes 317, 521 of the base 321 and the linkage 520 and secured with a cotter pin. Second and third pins are inserted, respectively, through the first bracket 511 of the pump lever 500 and the upper through-hole of the linkage 520, and through the second bracket 511 of the pump lever 500 and the through-hole of the piston 311, and are secured with a cotter pin. The jacking assembly 400 is, thus, formed.

Figure 2:
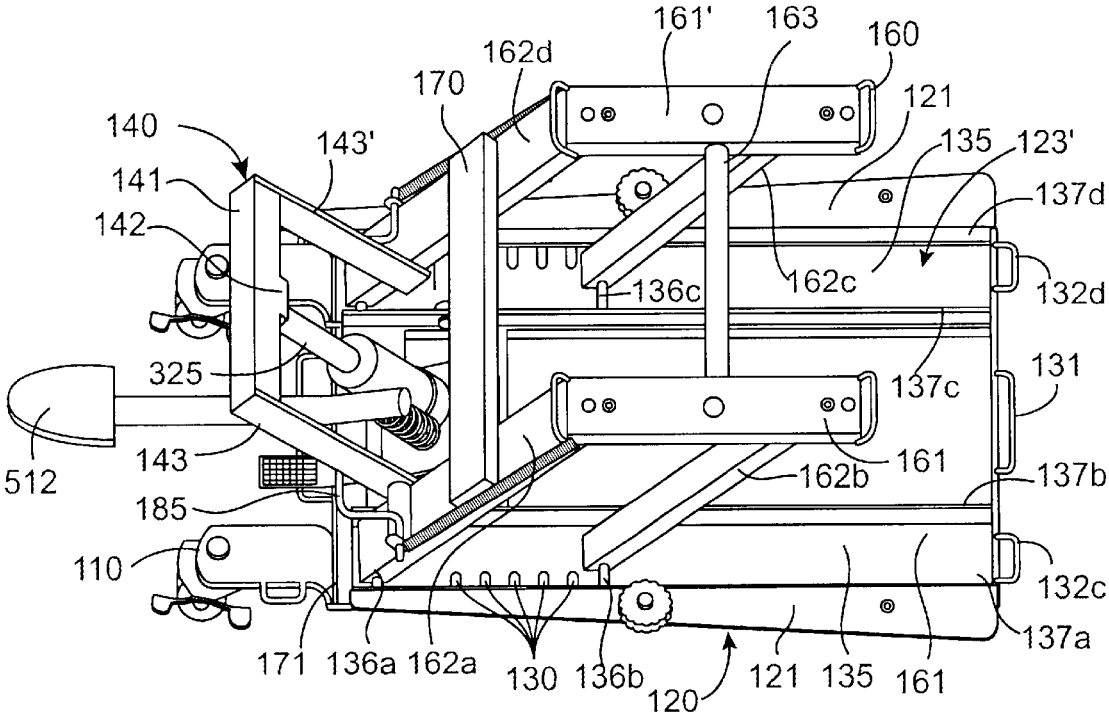
FIG. 2 is a perspective view from above the assembled lifting device assembly according to the preferred embodiment of the present invention with a support frame in a lifted position.

As shown in FIGS. 1 and 2, the base assembly 100 has a base frame 120, a front ram support 140, and a parallelogram support frame 160 for carrying a load. The base frame 120 is formed from parallel base members 121, 121' with casters 110, 110' at one end of each base member 121, 121' to facilitate the transportation of the lifting device 1. The parallel base members 121, 121' define a base plane.

The casters 110, 110' can be fixed by locking devices 111, 111', referred to as loop straps. The parallel base members 121, 121' are each formed with a recess 123, 123' (as best seen from FIG. 2) to allow the parallelogram support frame 160 to nest therein when the lifting device assembly 1 is in a down or lowered position. Thus, in cross-section, the base members 121, 121' each have a substantially U-shape.

A plurality of ratchet slots 130 are formed in bottom surfaces 135, 135' of each of the parallel base members 121, 121'. Two center beams 124, 124' and two end beams 124", 124'" fixedly connect the parallel base members 121, 121' to one another. The two end beams 124", 124'" respectively connect each of the ends of the support members 121, 121'.

In addition to the base members 121, 121', the support members 161, 161' and the lifting arms 162*a*, 162*b*, 162*c*, 162*d* all employ "open" shapes so that they can nest within each other, and, therefore, reduce the overall height of the lifting device assembly 1 in its lowered position. Preferably, the overall height in the lowered position is less than five inches, and, particularly, approximately three inches or less.

A jack assembly base 125 is formed between the two center beams 124, 124' and fixedly connected thereto. The jack assembly base 125 includes a first, sloped guide surface 126 and a second, substantially upright surface 128. The sloped guide surface 126 extends in a plane at an angle to a base plane. Attachment clamps 127 are formed on the slope guide surface 126 to hold the jacking assembly 400 thereon.

A release pedal 187 is pivotably connected to one of the center beam 124, the guide surface 126, or the ram base 321 after the hydraulic ram assembly 300 has been connected to the base assembly 100. Preferably, the release pedal 187 is pivotably connected to the ram base 321.

Figure 8:
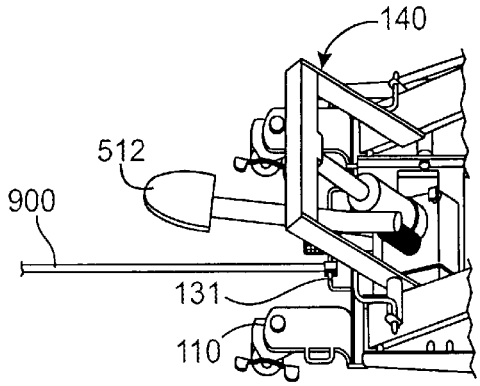
FIG. 8 is a partial perspective view from above the lifting device assembly of FIG. 1 showing the pulling handle.

A loop 131 can be formed on one or both of the end beams 124", 124'" for engaging with a pulling handle 900 to facilitate the transportation of the lifting device 1. FIG. 8 illustrates the pulling handle 900 engaged with loop 131 for moving the lifting device 1. Additional loops 132*a*, 132*b*, 132*c* and 132*d* can be formed at various portions of the base frame 120 to facilitate adjusting a position of the lifting device assembly 1 under a load.

As can be seen in FIG. 2, the parallelogram support frame 160 has two parallel, horizontal support members 161, 161' pivotally connected to and supported by the top ends of four lifting arms 162*a*, 162*b*, 162*c*, 162*d*. The bottom ends of these four lifting arms 162*a*, 162*b*, 162*c*, 162*d* are pivotably connected to the two horizontal base members 161, 161' through bolts 136*a*, 136*b*, 136*c*, 136*d* (136*d* cannot be seen in the drawings). The bolts 136*a*, 136*b*, 136*c*, 136*d* are supported through holes formed in the U-shape of the side surfaces 137*a*, 137*b*, 137*c*, 137*d* of the support members 121, 121' and fixed to the side surfaces by nuts.

A support bar 163 is fixedly connected, preferably by welding, between the two parallel support members 161, 161' to increase the strength of the support frame 160. A connecting beam 170 is fixedly attached, preferably by welding, on the two front lifting arms 162*a*, 162*d*.

The front ram support 140 includes a lifting beam 141 with a bracket 142 formed on the bottom surface thereof, and two lifting legs 143, 143'. Together, the lifting beam 141 and two lifting legs 143, 143' form an upside down, substantially U-shape. The bracket 142 is constructed to removably receive the cap 323 of the housing 320 when the hydraulic ram assembly 300 is connected to the lifting device assembly 1. The lifting legs 143, 143' are pivotably connected to the front lifting arms 162*a*, 162*d* on a pivot shaft at a pivot point lower on the front lifting arms 162*a*, 162*d* than the attachment point of the connecting beam 170. Preferably, the pivot point of the lifting legs 143, 143' is in the bottom one-third of the lifting legs 143, 143'.

Figure 10:
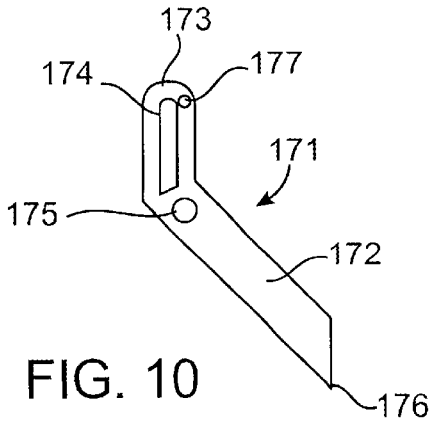
FIG. 10 is a side elevational view of a safety pawl of the lifting device assembly of FIG. 1.

Safety pawls 171, 171' are pivotally connected on the respective pivot shaft of the lifting legs 143, 143'. FIG. 10 illustrates one of the safety pawls 171, which has a locking part 172 with a locking point 176, a pivot hole 175 for receiving the pivot shaft, and a release part 173 with a long slot 174 formed therein. Alternatively, the slot 174 can also be the pivot hole.

Springs 180, 180' are connected between one end of the release part 173 of each safety pawl 171, 171' and a portion of the parallelogram support frame 160. Preferably, the springs 180, 180' are connected to an end of each support member 161, 161'. Alternatively, springs 180, 180' may also connect the safety pawls 171, 171' to the ends of the connecting beam 170.

As shown in FIG. 10, a hook hole 177 is formed in the end of the release part 173 of the safety pawl 171 to connect with a hook formed at one end of the spring 180. The locking point 176 of the locking part 172 of the safety pawl 171 engages within one of the slots 130 in the bottom surface 135 of the base member 121.

A release bar 185 is provided for substantially simultaneously releasing both of the safety pawls 171 from the slots 130. The release bar 185 is movably inserted in the long slot 174, preferably with a non-removable pin. Alternatively, the release bar 185 can also be pivotably fixed in the release part 173. Although only one of the safety pawl 171 is described above, it is to be understood that the other safety pawl 171' has the corresponding structure and is mounted on the other side of the lifting device 1.

Figure 4:
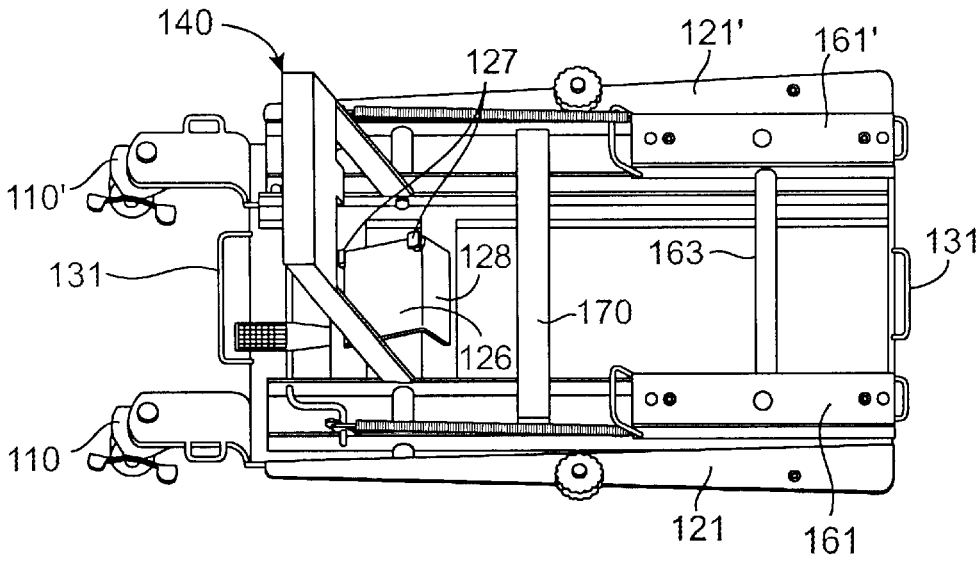
FIG. 4 is a perspective view of the base assembly of the lifting device assembly of FIGS. 1 and 2 showing that a front ram support has been lifted.
Figure 5:
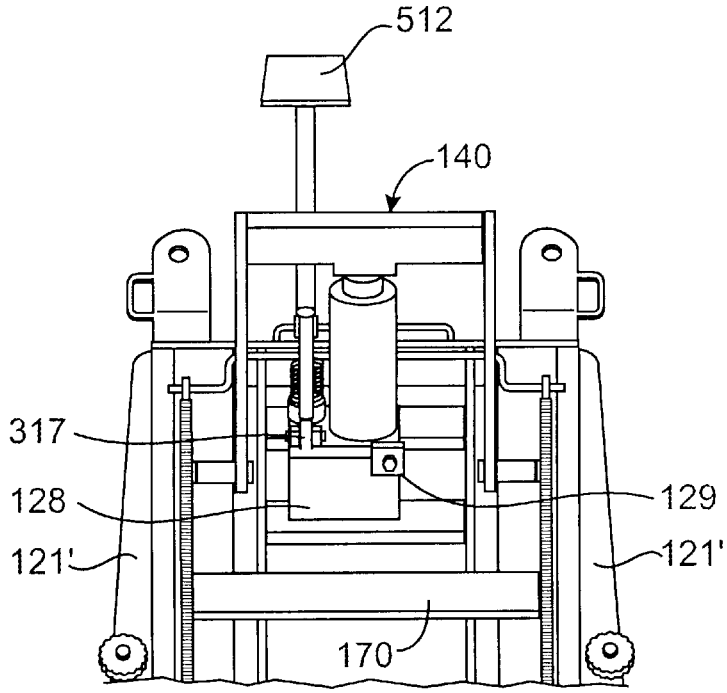
FIG. 5 is a partial perspective view from above the lifting device assembly of FIG. 1 showing the hydraulic ram assembly and the base assembly in an installed state.

FIGS. 4 and 5 illustrate how the jacking assembly 400 is connected to the base assembly 100. As shown in FIG. 4, the front ram support 140 is placed in a raised position. As shown in FIG. 5, with the foot pedal 512 of the foot pedal assembly 500 oriented toward the back (with respect to FIG. 5), the ram cap 323 is placed inside the bracket 142 of the front ram support 140 and the ram base 321 is aligned with at least one attachment clamp 127 attached to the slope guide surface 126, preferably, attached by welding. The entire jacking assembly 400 is secured to the guide surface 126 by tightening a bolt 129 of the clamp 127.

Figure 6:
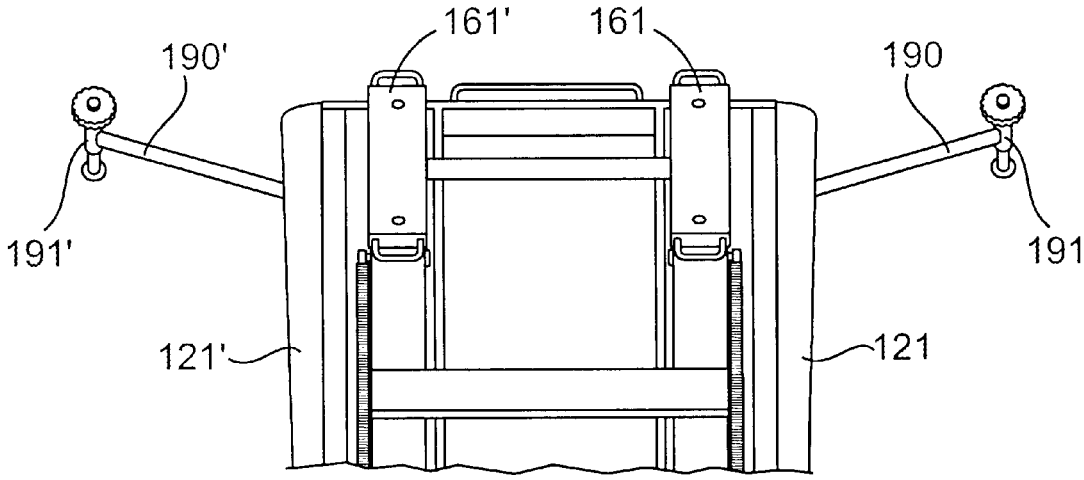
FIG. 6 is a partial perspective view from above the lifting device assembly of FIG. 1 showing the stabilizer arms.

As shown in FIG. 6, the base assembly 100 can have stabilizer arms 190, 190', preferably two in number, pivotably mounted at a side of the two base members 121, 121'. The stabilizer arms 190, 190' provide additional stability for the lifting device assembly 1 by extending the so-called "footprint" of the lifting device assembly 1 to a wider geography.

The lifting device assembly 1 has a length and a width, with the width being smaller than the length. Therefore, the lifting device assembly 1 is less stable along an extent of the width, than along the extent of the length. As such, it is desireable to extend the effective width of the device and/or extend the length of the device, depending on the orientation of the object to be lifted and balanced thereupon. To effectuate such an extension, stabilizer arms 190, 190' are provided.

In a preferred embodiment, the stabilizer arms 190, 190' extend the width of the device's footprint to at least two times the width of the device 1, as measured without such stabilizer arms 190, 190'. The stabilizer arms 190, 190' can be retracted or extended according to the needs of the user.

The stabilizer arms 190, 190' may be adjusted to provide side-to-side stability (width) or to enhance end-to-end stability (length) because they may be placed in one of many, separate, intermediate positions. If placed on the side of a base member 121, 121', for example, the stabilizer arms 190, 190' can rotate approximately through a 180 degree arc. Alternatively, if placed on a corner of a base member 121, 121', for example, the stabilizer arms 190, 190' can rotate approximately through a 270 degree arc.

Adjustment feet 191, 191' can be provided at the furthest end of the stabilizing arms 190, 190' to provide even contact with potentially uneven ground or pavement surfaces. Preferably, the adjustment feet 191, 191' each have a disk-shaped foot, a height-adjustment knob, and a threaded rod connecting the foot to the knob. Thus, when the knob is turned clockwise, for example, the foot moves lower with respect to the base members 121, 121', and when the knob is turned counter-clockwise, for example, the foot raises from that lowered position. Preferably, the feet can be raised slightly above the bottom of the base members 121, 121' so that varying terrain can be accommodated.

Figure 7:
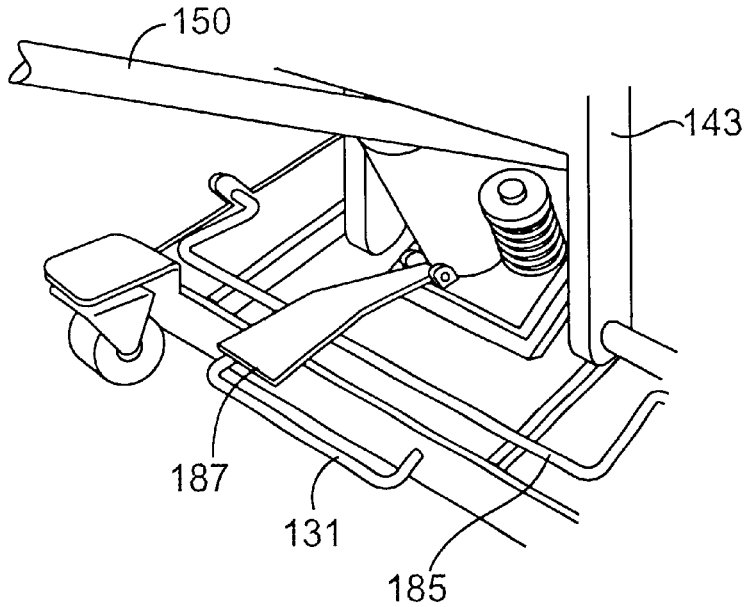
FIG. 7 is a partial perspective view from above the lifting device assembly of FIG. 1 showing the releasing assembly.

FIG. 7 illustrates the lowering device of the preferred embodiment of the present invention. As set forth above, depressing the pedal 187 begins the process of lowering the load on the lifting device assembly 1.

In an initial portion of the lowering movement, the pedal 187 presses down a first portion of the release bar 185 under the pedal 187. The downward movement of the first portion of the release bar 185 causes a corresponding pulling movement on the second portions of the release bar 185 that are connected to each of the two safety pawls 171, 171'. The pulling movement pivots the pawls 171, 171' such that a locking point 176 is removed from one of the slots 130 in the base members 121, 121'.

When the removal is complete, the safety pawls 171, 171' no longer prevent the support frame 160 from lowering, but the pressure existing within the ram assembly 300 does continue to prevent the support frame 160 from lowering. As such, pressing of the pedal 187 is continued to a second position in which a flange of the pedal 187 presses in the air leak button 329 of the ram assembly 300 to release the internal pressure within the housing 320.

Accordingly, the weight of the object and/or the support frame 160 causes the support frame 160 to lower towards a lowermost position nested within the base members 121, 121'. Because the release bar 185 is symmetrical with respect to the either side of the pressing point of the pedal 187, the safety pawls 171, 171' are substantially simultaneously released from the slots 130.

FIG. 8 illustrates an embodiment of the pulling handle 900 engaging the loop 131 at a side of the lifting device assembly 1 that is closest to the casters 110, 110'. It is to be understood that the pulling handle 900 may also engage with any other loop on the lifting device assembly 1 for moving the lifting device assembly 1 in different directions.

Figure 9:
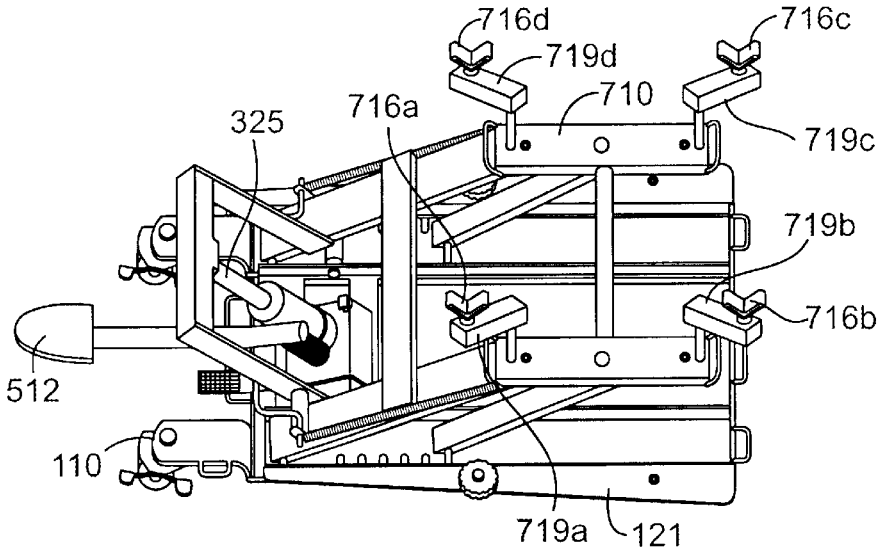
FIG. 9 is a perspective view from above the lifting device assembly of FIG. 1 showing the removable adapter assembly.

As shown in FIGS. 1 and 9, the removable adapter assembly 700 includes a substantially square adapter frame 710 having four screw holes 712*a*, 712*b*, 712*c*, 712*d* formed therein. The frame 710 also has four threaded adapter arms 715*a*, 715*b*, 715*c*, 715*d* that can be rotatably inserted in a respective screw hole 712*a*, 712*b*, 712*c*, 712*d* for raising and lowering each of the arms 715*a*, 715*b*, 715*c*, 715*d*.

The adapter frame 710 has another set of four through-holes 711*a*, 711*b*, 711*c*, 711*d* formed at each corner thereof for fixing the adapter frame 710 onto the support frame 160. Accordingly, the support members 161, 161' have four corresponding securing holes 711*a*', 711*b*', 711*c*', 711*d*'. The through-holes 711*a*, 711*b*, 711*c*, 711*d* and securing holes 711*a*', 711*b*', 711*c*', 711*d*' are aligned so that the frame 710 can be removably attached to the lifting device assembly 1 using, for example, screws or nuts and bolts.

Preferably, one of the two sets of four holes is threaded so that a single threaded bolt with a head larger than a diameter of the other hole can be used to secure the frame 710. In one preferred embodiment, the head has wing extensions so that a user can tighten the bolt without using a separate tool.

Preferably, the adapter frame 710 is rectangular or square. Each adapter arm 715*a*, 715*b*, 715*c*, 715*d* includes a vertical portion 717*a*, 717*b*, 717*c*, 717*d* formed with a thread and a horizontal head portion 718*a*, 718*b*, 718*c*, 718*d* having a lengthened slot 719*a*, 719*b*, 719*c*, 719*d* (see FIG. 8).

A respective padded rotating receiver 716*a*, 716*b*, 716*c*, 716*d* is movably mounted within the slot. By moving the respective padded receiver 716*a*, 716*b*, 716*c*, 716*d* within the slot and turning the thread into the respective screw hole 712*a*, 712*b*, 712*c*, 712*d*, the height, rotation and extension of each padded receivers 716*a*, 716*b*, 716*c*, 716*d* can be adjusted individually so as to provide stable support for non-flat or irregular surfaces. Thus, each of the adapter arms 715*a*, 715*b*, 715*c*, 715*d* has a full three degrees of movement. The adapter frame assembly 700 can be used either as a retrofitted attachment to an existing lifting device or incorporated into the lifting device assembly 1 of the preferred embodiment of the present invention.

The following paragraphs describe the operation of the lifting device of the preferred embodiment of the present invention.

First, the lifting device assembly 1 is placed under a load to be lifted. If desired, the pulling handle 900 can be used to place the lifting device assembly 1. When the lifting device assembly 1 is located in the right position under the load, the foot pedal 512 is depressed. If desired, to provide additional stability, the stabilizer arms 190, 190' may be extended to a suitable position prior to depressing the foot pedal 512.

The return spring 313 provides the return action of each depression of the foot pedal 512. The plunger 325 of the ram assembly 300 lifts during each pumping action. Such lifting, in turn, raises the lifting beam 141 with respect to the base members 121, 121'. Because the bottom of the lifting beam 141 is connected to the two lifting arms 162*a*, 162*d*, a raising of the lifting beam 141 causes a corresponding counter-clockwise rotation (with respect to FIG. 2) of the lifting arms 162*a*, 162*d* about their pivot axis, which are within the recess 123, 123' of each base member 121, 121'. Because lifting arms 162*b*, 162*c* are connected to lifting arms 162*a*, 162*d* through the support members 161, 161', the entire support frame 160 raises with respect to the base members 121, 121'.

In the mean time, the springs 180, 180' provide a lifting force upon the end of each safety pawl 171, 171'. Thus, the locking point 176 of each safety pawl 171, 171' engages one of the slots 130 in the bottom surface 135 of the base members 121, 121' in the manner of a ratchet as the ram assembly 300 lifts. The lock prevents the support frame 160 from unintentionally lowering should the pressure in the ram assembly 300 be unexpectedly lost.

To lower the support frame 160, the release pedal 187 is pressed into an initial position whereby the release bar 185 under the release pedal 187 moves downward and, correspondingly, simultaneously pivots both of the safety pawls 171, 171' out of their respective slots 130. Specifically, the release bar 185 pulls down the end of the release part 173 of the locking pawl 171, 171' and disengages the locking point 176 from the slot 130.

The release pedal 187 is pressed further down to a final position where a flange on the pedal 187 contacts and presses in the air leak button 329. The air in the ram cylinder 322 slowly leaks out from the air exit cylinder 326. The plunger 325 and the parallelogram support frame 160 slowly lower down under the weight of the load.

While the manner, operation and principles of the present invention has been illustrated and described by a specific preferred embodiment, it is to be understood that numerous changes and modifications may be made without departing from the spirit and scope of the invention as defined in the appended claims.

What is claimed is:

1. A jack for lifting an object, comprising:

a base assembly having:

a frame with a base member having a nesting chamber;

lifting arms pivotably connected to said base member;

a support member for supporting the object to be lifted, said support member pivotably connected to said lifting arms and disposed parallel to said base member;

said support member and said lifting arms pivoting with respect to said base members into positions including:

a fully raised position wherein said support member is lifted away from said base member; and a fully lowered position wherein said support members and said lifting arms are at least partly nested within said nesting chamber;

a jacking assembly connected to said base assembly for moving said support members and said lifting arms from said fully lowered position towards said fully raised position; and a lowering assembly connected to said base assembly and to said jacking assembly for lowering said support member and said lifting arms toward said fully lowered position and for lowering said jacking assembly, said lowering assembly having a lowering pedal pivotably connected to said jacking assembly and a release bar pivotably connected to said base assembly.

2. The jack according to claim 1, wherein:

said base member is two base members disposed parallel to one another in a base plane; and each of said two base members has a nesting chamber.

3. The jack according to claim 2, wherein each of said two base members has a U-shaped cross-section defining said nesting chamber.

4. The jack according to claim 1, wherein:

said support member has a second nesting chamber; and at least one of said lifting arms is at least partly nested within said second nesting chamber when in said fully lowered position.

5. The jack according to claim 1, wherein:

said base member is two base members parallel to one another in a base plane;

each of said two base members has a nesting chamber;

said support member is two support members disposed parallel to one another in a support member plane;

said support member plane is parallel to said base plane;

said two support members and said lifting arms are at least partly nested within said nesting chamber when in said fully lowered position; and at least one of said lifting arms is at least partly nested within said second nesting chamber of each of said two support members when in said fully lowered position.

6. The jack according to claim 2, wherein each of said two base members has a series of ratchet openings disposed in said nesting chamber.

7. The jack according to claim 2, wherein said frame includes cross-beams fixedly connecting said two base members to one another.

8. The jack according to claim 7, wherein:

said cross-beams include a first cross-beam and a second cross-beam; and said frame includes a jack assembly base fixedly connected to said first and second cross-beams.

9. The jack according to claim 8, wherein said jack platform has:

a first sloped guide surface attached to said first cross-beam; and a second sloped guide surface connected to said first leg and to said second cross-beam.

10. The jack according to claim 1, wherein said lifting arms are four lifting arms.

11. The jack according to claim 10, wherein each of said four lifting arms has a substantially same given arm length.

12. The jack according to claim 10, wherein:

said base member is two base members disposed parallel to one another in a base plane; and a pair of said four lifting arms is pivotably connected to each of said two base members.

13. The jack according to claim 1, wherein said support member is two support members.

14. The jack according to claim 12, wherein:

said support member is two support members;

said two support members are disposed parallel to one another and parallel to said two base members, and each of said two support members is pivotably connected to said pair of said four lifting arms.

15. The jack according to claim 14, wherein, said two support members and said four lifting arms pivot with respect to said two base members into positions including:

a fully raised position wherein said two support members are lifted away from said two base members; and a fully lowered position wherein one of said two support members and two of said four lifting arms are each at least partly nested within a nesting chamber of a respective one of said base members.

16. The jack according to claim 1, wherein said jacking assembly includes:

a ram support pivotably connected to said lifting arms; and a removable hydraulic ram assembly removably connected to said ram support and to said base assembly, said ram assembly moving said support member and said lifting arms from said fully lowered position towards said fully raised position through said ram support.

17. The jack according to claim 16, wherein:

said lifting arms are four lifting arms;

two of said four lifting arms are disposed closer to said hydraulic ram assembly than two other arms of said four lifting arms;

each of said two lifting arms disposed closer to said jacking assembly has a pivot; and said ram support is pivotably connected to a respective one of said two lifting arms disposed closer to said hydraulic ram assembly at said pivot.

18. The jack according to claim 16, wherein:

said frame includes a jack assembly base fixedly coupled to said base member; and said jack assembly base has an attachment clamp removably connecting said jack to said jack platform.

19. The jack according to claim 16, wherein:

said base member is two base members disposed parallel to one another in a base plane;

said frame includes cross-beams fixedly connecting said two base members to one another;

said cross-beams include a first cross-beam and a second cross-beam;

said frame includes a jack assembly base fixedly coupled to said first and second cross-beams;

said jack assembly base has an attachment clamp removably connecting said hydraulic ram assembly to said jack assembly base.

20. The jack according to claim 8, wherein said jack assembly base is disposed in a plane at an angle from said base plane.

21. The jack according to claim 18, wherein:

said base member is disposed in a base plane; and said attachment clamp removably connects said jack to said jack platform in a plane at an angle from said base plane.

22. The jack according to claim 19, wherein:

said base member is disposed in a base plane; and said attachment clamp removably connects said jack to said jack platform in a plane at an angle from said base plane.

23. The jack according to claim 16, wherein:

said frame includes a jack assembly base fixedly coupled to said base member;

said jack assembly base has an attachment clamp; and said hydraulic ram assembly has:

a base housing a hydraulic fluid;

a lifting piston moveably disposed in said base housing, said lifting piston having a piston end and a cap disposed at said piston end, said attachment clamp of said jack assembly base removably connecting said base housing to said jack assembly base such that said lifting piston has an axis inclined with respect to said base plane;

a pumping piston moveably connected to said base housing for exerting pressure upon said hydraulic fluid when moved into a downward position and correspondingly raising said lifting piston out of said base housing along said axis;

a return spring connected to said pumping piston for returning said pumping piston to a raised position;

a pedal flange pivotably connected to said base;

a pedal pivotably connected to said pedal flange, pivotably connected to said pumping piston, and connected to said return spring such that, when said pedal is depressed from an initial position, said pedal depresses said pumping piston, and, when pressure is released from said pedal, said return spring returns said pedal to said initial position; and a pressure release valve connected to said base for releasing pressure upon said hydraulic fluid.

24. The jack according to claim 23, wherein:

said front ram support has:

an upper span having two ends and a bracket removably connected to said cap of said lifting piston; and two side spans each having an upper end and a lower end;

said upper end of each of said two side spans is fixedly connected to a respective one of said two ends of said upper span to form a U-shape;

said lifting arms include two lifting arms disposed closer to said jacking assembly than other arms of said lifting arms;

each of said two lifting arms have a pivot; and said lower end of each of said two side spans is pivotably connected to a respective one of said two lifting arms at said pivot.

25. The jack according to claim 1, including a locking assembly connected to said base assembly for locking said base assembly in one of said positions.

26. The jack according to claim 25, wherein said locking assembly is connected to said lifting arms.

27. The jack according to claim 26, wherein:

said lifting arms include two lifting arms; and said locking assembly is connected to said two lifting arms.

28. The jack according to claim 27, wherein:

each of said two lifting arms has a pivot;

said locking assembly has two locking pawls each having a ratchet portion and an actuating portion;

each of said two locking pawls is pivotably connected to a respective one of said two lifting arms at said pivot for holding said two lifting arms in one of said positions.

29. A jack for lifting an object, comprising:

a base assembly having:

a frame with a base member having a nesting chamber;

lifting arms pivotably connected to said base member;

a support member for supporting the object to be lifted, said support member pivotably connected to said lifting arms and disposed parallel to said base member;

said support member and said lifting arms pivoting with respect to said base members into positions including:

a fully raised position wherein said support member is lifted away from said base member; and a fully lowered position wherein said support members and said lifting arms are at least partly nested within said nesting chamber;

a jacking assembly connected to said base assembly for moving said support members and said lifting arms from said fully lowered position towards said fully raised position, said jacking assembly including a ram support pivotably connected to said lifting arms and a removable hydraulic ram assembly removably connected to said ram support and to said base assembly, said ram assembly moving said support member and said lifting arms from said fully lowered position towards said fully raised position through said ram support; and said lifting arms include two lifting arms each having a pivot;

a locking assembly is connected to said base assembly and has two locking pawls each with a ratchet portion and an actuating portion;

each of said two locking pawls is pivotably connected to a respective one of said two lifting arms at said pivot;

said ratchet portion has a locking end;

said base member has ratchet openings;

said jack has a pressure release valve;

a lowering assembly has:

a lowering pedal with a pressure release flange, said lowering pedal pivotably connected to said jack; and a release bar pivotably connected to each of said two locking pawls at said actuating portion and connected to said lowering pedal such that, when said lowering pedal is initially depressed, said release bar pivots both of said two locking pawls to disconnect said locking end from a respective one of said ratchet openings, and, when said lowering pedal is further depressed, said pressure release flange contacts and moves said pressure release valve to release pressure in said jack thereby lowering said lifting arms and said support member towards said fully lowered position.

30. A jack for lifting an object, comprising:

a base assembly including:

a frame including:

two base members disposed parallel to one another in a base plane, each of said two base members having:

a U-shaped cross-section defining a nesting chamber; and a series of ratchet openings;

cross-beams fixedly connecting said two base members to one another;

a jack platform fixedly connected to two of said cross-beams, said jack platform having an attachment clamp, a first leg, and a second leg longer than said first leg, said second leg disposed at an angle from said base plane;

four lifting arms, a pair of said four lifting arms pivotably connected to each of said two base members, each of said four lifting arms having a substantially same given arm length;

two support members for supporting an object to be lifted, said two support members disposed parallel to one another in a support plane parallel to said base plane and parallel to said two base members, said two support members each pivotably connected to a pair of said four lifting arms;

said two support members and said four lifting arms pivoting with respect to said two base members into positions including:

a fully raised position wherein said two support members are lifted away from said two base members; and a fully lowered position wherein one of said two support members and two of said four lifting arms are at least partly nested within a nesting chamber of a respective one of said base members; and a jacking assembly for moving said two support members and said four lifting arms from said fully lowered position towards said fully raised position, said jacking assembly including:

a hydraulic jack including:

a base housing a hydraulic fluid;

a lifting piston moveably disposed in said base, said lifting piston having a piston end and a cap disposed at said piston end, said attachment clamp of said jack platform removably connecting said base to said second leg of said jack platform such that said lifting piston has an axis inclined with respect to said base plane;

a pumping piston moveably connected to said base for exerting pressure upon said hydraulic fluid when moved into a downward position and correspondingly raising said lifting piston out of said base along said axis;

a return spring connected to said pumping piston for returning said pumping piston to a raised position;

a pedal flange pivotably connected to said base;

a pedal pivotably connected to said pedal flange, pivotably connected to said pumping piston, and connected to said return spring such that, when said pedal is depressed from an initial position, said pedal depresses said pumping piston, and, when pressure is released from said pedal, said return spring returns said pedal to said initial position; and a pressure release valve connected to said base for releasing pressure upon said hydraulic fluid;

a front ram support including:

an upper span with two ends and a bracket removably connected to said cap of said lifting piston; and two side spans each having an upper end and a lower end;

said upper end of each of said two side spans fixedly connected to a respective one of said two ends of said upper span to form a U-shape;

two of said four lifting arms disposed closer to said jacking assembly than two other arms of said four lifting arms;

each of said two lifting arms disposed closer to said jacking assembly having a pivot; and said lower end of each of said two side spans pivotably connected to a respective one of said two lifting arms disposed closer to said jacking assembly at said pivot;

a locking assembly including:

two locking pawls each with a ratchet portion and an actuating portion, said ratchet portion having a locking end; and each of said two locking paw is pivotably connected to a respective one of said two lifting arms disposed closer to said jacking assembly at said pivot;

a lowering assembly including:

a lowering pedal having a pressure release flange, said lowering pedal pivotably connected to said base; and a release bar pivotably connected to each of said two locking pawls at said actuating portion and connected to said lowering pedal such that, when said lowering pedal is initially depressed, said release bar pivots both of said two locking pawls to disconnect said locking end from a respective one of said ratchet openings, and, when said lowering pedal is further depressed, said pressure release flange contacts and moves said pressure release valve to release pressure upon said hydraulic fluid thereby lowering said four lifting arms and said two support members towards said fully lowered position.

* * * * *